US005687647A

United States Patent [19]

Vrotacoe et al.

[11] Patent Number: 5,687,647

[45] Date of Patent: Nov. 18, 1997

[54] PLATE CYLINDER WITH FIXED TENSIONING PLATE MOUNTING DEVICE

[75] Inventors: James Brian Vrotacoe, Rochester; Roland Thomas Palmatier, Durham; Howard Walter Hoff, Lee; Richard L. McKrell, Rye, all of N.H.

[73] Assignees: Heidelberger Druckmaschinen AG, Heidelberg, Germany; Heidelberg Harris, Inc., Dover, N.H.

[21] Appl. No.: 639,135

[22] Filed: Apr. 26, 1996

[51] Int. Cl.[6] ..... B41F 13/10; B41F 21/00; B41F 7/02

[52] U.S. Cl. ..... 101/375; 101/142; 101/415.1; 101/216; 101/486

[58] Field of Search ..... 101/212, 216, 101/217, 375, 376, 378, 383, 415.1, 477, 486, DIG. 36, 453, 142; 29/895, 895.2, 895.21, 895.23

[56] References Cited

U.S. PATENT DOCUMENTS

| | | | |
|---|---|---|---|
| 1,963,745 | 6/1934 | Ingersol et al. | 29/895.21 |
| 2,375,603 | 5/1945 | Willard | 101/415.1 |
| 2,869,966 | 1/1959 | Cunningham | 101/415.1 |
| 3,146,709 | 9/1964 | Bass et al. | 101/375 |
| 3,187,542 | 6/1965 | Heller | 72/321 |
| 4,495,865 | 1/1985 | Kamoda | 101/415.1 |
| 4,598,642 | 7/1986 | Säuer et al. | 101/415.1 |
| 4,762,064 | 8/1988 | Moore | 101/415.1 |
| 4,823,693 | 4/1989 | Köbler | 101/218 |
| 4,833,986 | 5/1989 | Kobler | 101/415.1 |
| 4,856,425 | 8/1989 | Köbler | 101/216 |
| 4,932,324 | 6/1990 | Pinkston et al. | 101/486 |
| 4,951,568 | 8/1990 | Tsukamoto et al. | 101/415.1 |
| 4,964,338 | 10/1990 | Fantoni et al. | 101/378 |
| 5,080,014 | 1/1992 | Hofheinz | 101/415.1 |
| 5,125,337 | 6/1992 | Zeller | 101/217 |
| 5,245,924 | 9/1993 | Kiamco et al. | 101/415.1 |
| 5,379,693 | 1/1995 | Hoffmann et al. | 101/375 |
| 5,488,903 | 2/1996 | Köbler et al. | 101/375 |
| 5,526,746 | 6/1996 | Capdeboscq | 101/415.1 |

FOREIGN PATENT DOCUMENTS

| | | | |
|---|---|---|---|
| 44 04 758 | 8/1995 | Germany . | |
| 0107843 | 7/1982 | Japan | 101/375 |
| 0578777 | 8/1946 | United Kingdom | 101/375 |

*Primary Examiner*—Christopher A. Bennett
*Attorney, Agent, or Firm*—Kenyon & Kenyon

[57] ABSTRACT

A printing plate has an outer surface and an inner surface, the outer surface for receiving an image to be transferred to a printing blanket. The printing plate also includes a lead end and a tail end. A first bend and a second bend are formed at a first distance from the lead end of the printing plate, and a third bend is formed at a second distance from the lead end. A recessed portion is thereby formed between the second bend and the third bend, and an angular end portion is formed between the third bend and the lead end. The tail end of the printing plate is bonded to the recessed portion with an adhesive. In order to install the printing plate on the plate cylinder, the source of pressurized fluid is engaged to supply pressurized fluid, e.g. air, through the apertures of the plate cylinder. A press operator mounts an end of the printing plate onto the plate cylinder, aligning the angular end portion of the printing plate with the slot in the plate cylinder. The pressurized fluid effects a radial expansion of the printing plate so that the printing plate can be slid axially over the plate cylinder. Once the printing plate has been slid over the entire length of the plate cylinder, the source of pressurized fluid is disengaged, the printing plate undergoes a radial contraction, and the printing plate is securely fixed to the plate cylinder.

24 Claims, 9 Drawing Sheets

PLATE CYLINDER WITH FIXED TENSIONING PLATE MOUNTING DEVICE

FIELD OF THE INVENTION

The present invention relates to printing presses, and more particularly, to printing plates and mechanisms for mounting printing plates onto plate cylinders of printing presses.

BACKGROUND INFORMATION

Printing elements for offset printing presses have traditionally been formed as flat plates which are mounted within an axially extending gap in a plate cylinder. Within the gap in the plate cylinder, a plate lock-up mechanism, such as a reel-rod mechanism, is provided for securing the opposing ends of the printing plate within the cylinder gap. Typical reel-rod mechanisms, however, require a relatively large gap in the cylinder which causes vibrations and print defects during printing. In addition, reel-rod mechanisms do not provide uniform tensioning across the width of the printing plate. Non-uniform tensioning, in turn, may cause the printing plate to crack prematurely.

U.S. Pat. No. 5,284,093 to Guaraldi describes a plate lock-up mechanism which allows the use of a particularly narrow plate cylinder gap. This reduction in the size of the gap in the plate cylinder reduces vibrations and print defects. In addition, since this plate lock-up mechanism applies very little tension to the printing plate, the likelihood of plate cracking is reduced. However, this plate lock-up mechanism utilizes a complicated mechanical mounting system.

In order to eliminate the vibrations associated with the cylinder gap, it has been proposed in U.S. Pat. No. 4,913,048 to Tittgemeyer to form the printing element as a sleeve shaped print form, and to mount the sleeve shaped print form axially over a gapless print cylinder by expanding the print form with compressed air. This design had the additional advantage of allowing the print forms to be removed and installed more quickly than flat printing plates. However, sleeve shaped print forms have proved difficult to manufacture. Moreover, since such sleeve shaped print forms were secured to the print cylinder through a friction fit, they were subject to slippage between the print form and cylinder. Finally, sleeve shaped print forms were undesirable because they could not be imaged with conventional plate-making equipment, and because the strength of the plate at the weld area was inadequate.

SUMMARY OF THE INVENTION

In accordance with the present invention, a system is provided for axially mounting a flat printing plate over a plate cylinder while providing uniform tensioning of the printing plate during installation and removal of the printing plate, and during printing.

In accordance with the present invention, a printing unit of a printing press includes a blanket cylinder and a plate cylinder, the plate cylinder having an axially extending slot therein. A recess is provided along the axially extending slot. The plate cylinder has a plurality of apertures arranged on its outer surface, the apertures being connected to a source of pressurized fluid such as an air compressor.

A printing plate has an outer surface and an inner surface, the outer surface for receiving an image to be transferred to a printing blanket. The printing plate also includes a lead end and a tail end.

In accordance with a first embodiment of the present invention, a first bend and a second bend form opposing angles at a first distance from the lead end of the printing plate, and a third bend forms an opposing angle relative to the second bend at a second distance from the lead end. A recessed portion is thereby formed between the second bend and the third bend, and an angular end portion is formed between the third bend and the lead end. The second distance is less than or equal to the depth of the axially extending slot. The first distance is approximately equal to the second distance plus the width of the recess of the plate cylinder. The tail end of the printing plate is bonded to the recessed portion by welding or with an adhesive.

In order to install the printing plate on the plate cylinder, the source of pressurized fluid is engaged to supply pressurized fluid (e.g. air, another gas, or liquid) through the apertures of the plate cylinder. A press operator mounts an end of the printing plate onto the plate cylinder, aligning the angular end portion of the printing plate with the slot in the plate cylinder. The pressurized fluid effects a radial expansion of the printing plate so that the printing plate can be slid axially over the plate cylinder. Once the printing plate has been slid over the entire length of the plate cylinder, the source of pressurized fluid is disengaged, and the printing plate contracts and is securely fixed to the plate cylinder. In addition, since the angular end portion of the printing plate is disposed within the slot of the plate cylinder, there will be no slippage between the plate cylinder and printing plate during printing.

In accordance with a second embodiment of the present invention, a T-shaped bonding plate is provided, and the inner surface of the lead end and tail end of the printing plate are bonded to the bonding plate by welding or with an adhesive. In order to install the printing plate on the plate cylinder, the source of pressurized fluid is engaged to supply pressurized fluid (e.g. air, another gas, or liquid) through the apertures of the plate cylinder. A press operator mounts an end of the printing plate onto the plate cylinder, aligning the bonding plate with the recess and slot in the plate cylinder. The pressurized fluid effects a radial expansion of the printing plate so that the printing plate can be slid axially over the plate cylinder. Once the printing plate has been slid over the entire length of the plate cylinder, the source of pressurized fluid is disengaged, and the printing plate contracts and is securely fixed to the plate cylinder. In addition, since the bonding plate is disposed within the axial slot of the plate cylinder, there will be no slippage between the plate cylinder and printing plate during printing.

BRIEF DESCRIPTION OF THE DRAWINGS

FIG. 7(*b*) illustrates the manner in which the printing plate of FIG. 2 is mounted onto the mounting mandrel of FIG. 7(*a*).

FIG. 7(*c*) illustrates a method of forming an axially removable printing plate in accordance with the present invention.

FIG. 7(*d*) shows a further embodiment of the mounting mandrel.

DETAILED DESCRIPTION OF THE INVENTION

Figure 1:
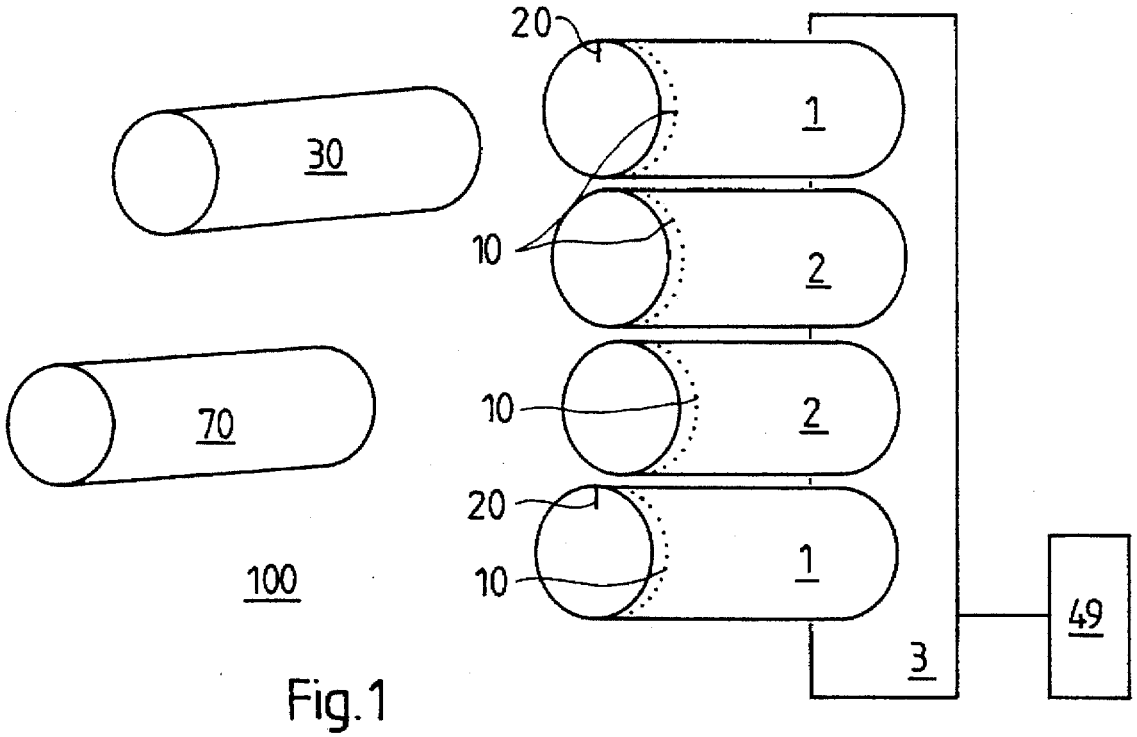
FIG. 1 shows an offset printing press in accordance with the present invention.
Figure 2:
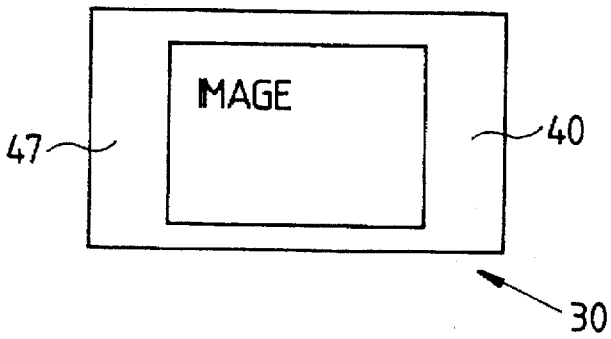
FIG. 2 shows a printing plate.
Figure 3:
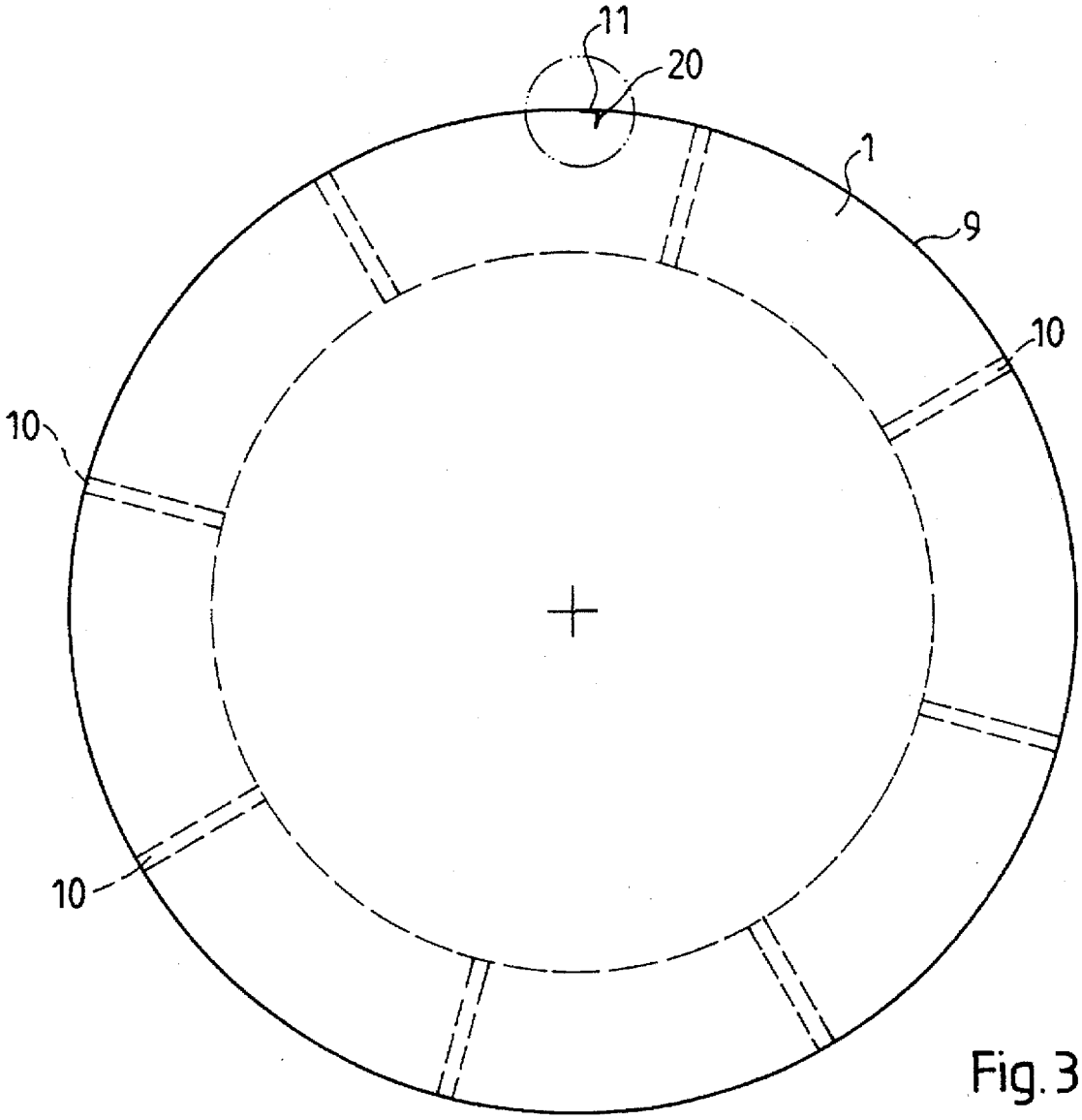
FIG. 3 shows a plate cylinder in accordance with a first embodiment of the present invention.

FIG. 1 shows a printing press 100 including a plate cylinder 1 and a blanket cylinder 2 rotatably mounted within a frame 3. As shown in FIG. 2, a printing plate 30 is formed as a flat sheet having a lead end 40 and a tail end 47. An image to be printed is exposed on one side of the plate 30. FIG. 3 shows the plate cylinder 1 in more detail. The plate cylinder 1 includes a plurality of apertures 10 along the outer surface 9 of the cylinder 1. The apertures 10 are coupled to a source of pressurized fluid 49 (e.g., an air compressor) as shown in FIG. 1. The plate cylinder 1 includes an axial slot 20 for receiving the lead end 40 of the printing plate 30 as described below. An axial recess 11 is provided adjacent to the slot 20.

Figure 4A:
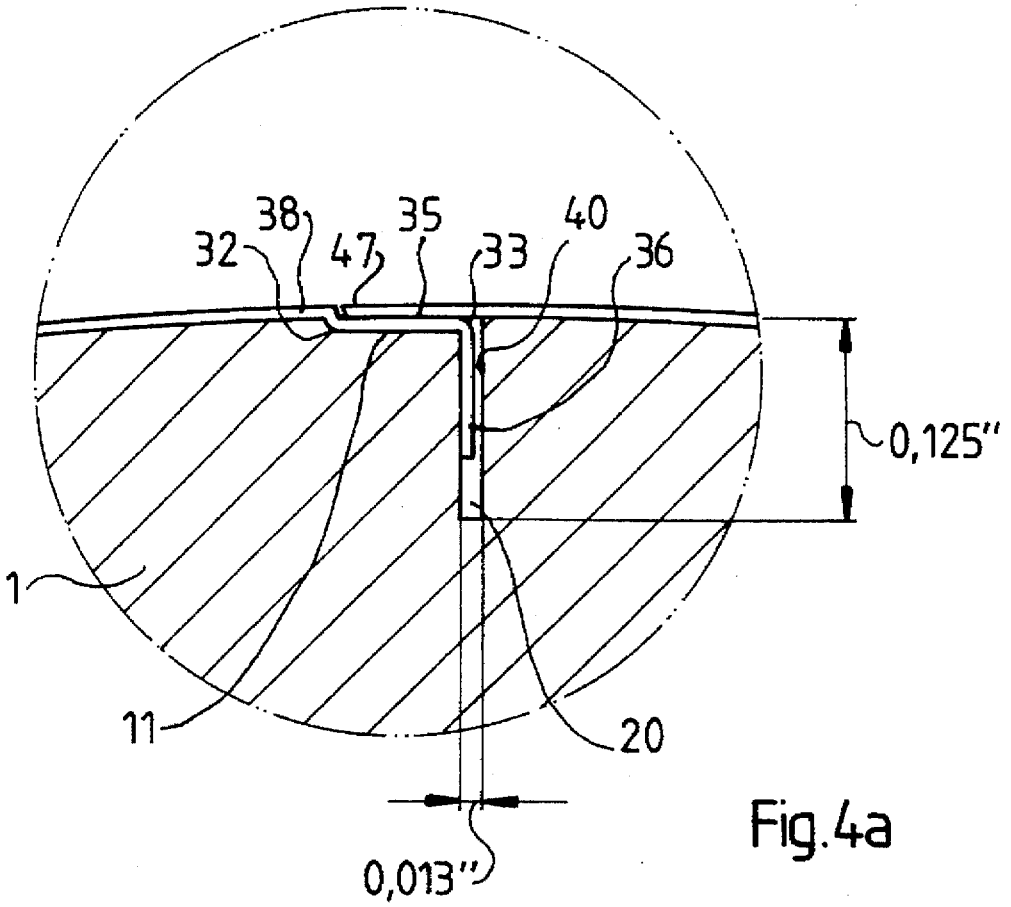
FIGS. 4(*a–c*) show the printing plate of FIG. 2 mounted on a plate cylinder in accordance with the first embodiment of the present invention.
Figure 4B:
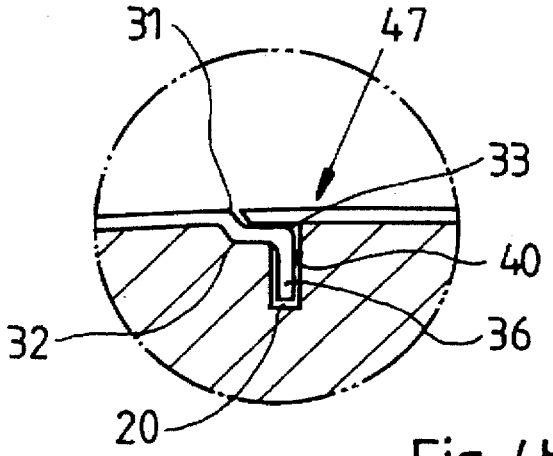
Figure 4C:
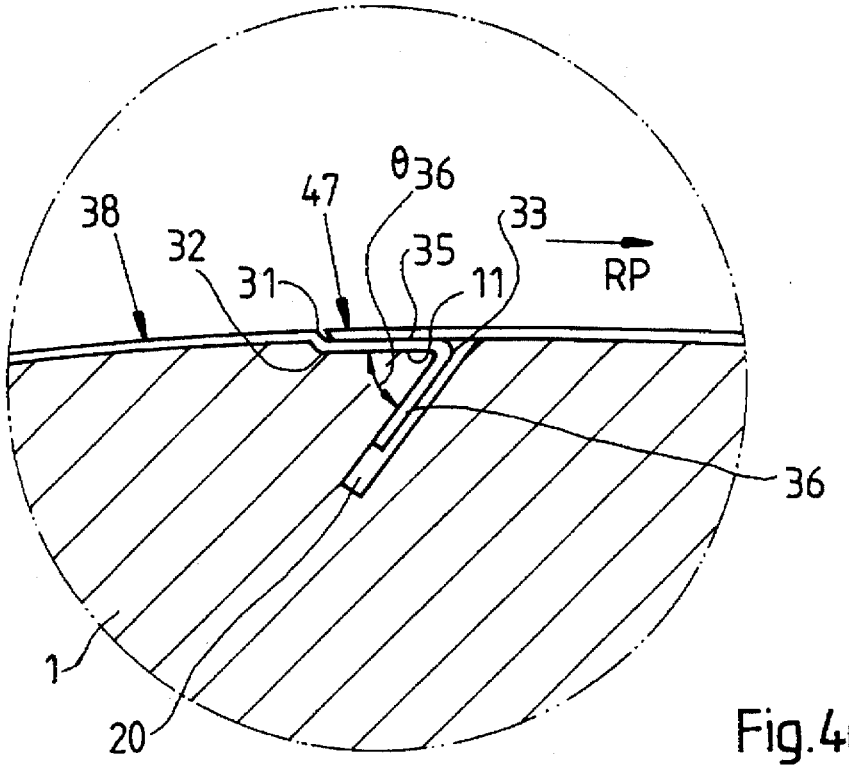

FIG. 4(*a*) shows the printing plate 30 mounted on the plate cylinder 1 in accordance with a fast embodiment of the present invention. As illustrated, three bends have been made in the lead end 40 of the plate 30. A first bend 31 and an opposing second bend 32 form an overlap joint. These bends 31, 32 form a recessed portion 35 of the printing plate which rests in the axial recess 11 of the plate cylinder 1. A third bend 33 forms an angular end portion 36 of the printing plate which rests in the slot 20 of the plate cylinder 10. The tail end 47 of the printing plate is bonded to the recessed portion 35 by welding or with a suitable adhesive, such as, for example, an epoxy or a quick setting cyanacrylate ester. The recessed portion 35 is constructed so that when the tail end 47 is adhered to the portion 35, the tail end 47 is approximately the same height as the adjacent portion 38 of the lead end 40.

This construction results in a small gap on the printing plate surface, but this gap is much smaller than the gap that would otherwise be attainable with a plate lockup mechanism such as the mechanism disclosed in U.S. Pat. No. 5,284,093. As illustrated in FIG. 4(*a*), the slot 20 could, for example, have a width of 0.013 inches and a depth of 0.125 inches. Moreover, in accordance with a further embodiment of the present invention, the tail end 47 is beveled as illustrated in FIG. 4*b* to further reduce the size of the gap. The smaller gap of FIGS. 4(*a,b*) results in a reduction in bounce disturbances as compared to conventional gapped plate cylinders. In addition, since the angular end portion 36 is secured within the slot 20, the plate 30 will not move relative to the plate cylinder 1 during printing. Therefore, unlike the system of U.S. Pat. No. 4,913,048, the plate mounting system according to the present invention is not subject to the print defects resulting from slippage between the printing plate and the plate cylinder.

In the embodiment shown in FIGS. 1–4(*b*), the slot 20 in the plate cylinder 1 extends perpendicularly from the axial recess 11. However, as shown in FIG. 4(*c*), in accordance with a further embodiment of the present invention, the slot 20 may be formed at an acute angle $\theta_{36}$ relative to the axial recess 11 of the plate cylinder, and the angular end portion may likewise form an angle $\theta_{36}$ relative to the recessed portion 35 of the printing plate. With this construction, as the plate cylinder rotates in the direction RP, the force exerted on the plate 30 by the blanket cylinder flows in the direction of the slot 20, keeping the angular end portion 36 securely mounted within the slot 20 during printing.

Figure 5:
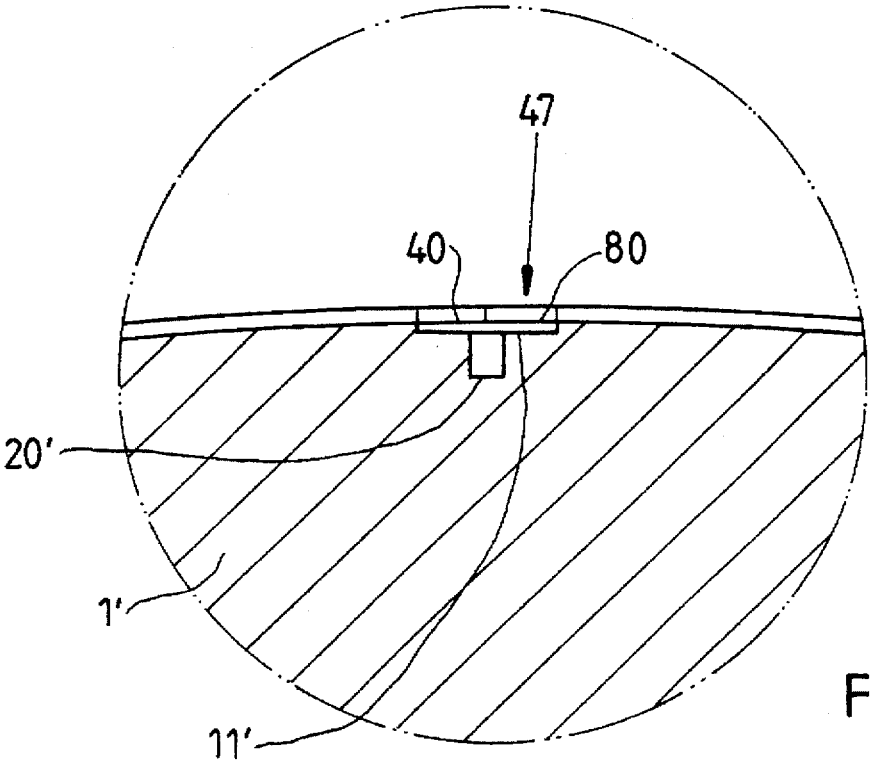
FIG. 5 shows the printing plate of FIG. 2 mounted on a plate cylinder in accordance with a second embodiment of the present invention FIGS. 6(*a,b*) show a prior an reel-rod mechanism, and the forces resulting from mounting a printing plate onto a plate cylinder with the reel-rod mechanism.

Referring to FIG. 5, in accordance with a second embodiment of the present invention, the lead end and tail end (40,47) of the printing plate 30 are bonded to a T-shaped bonding plate 80. In this embodiment, no bends are made in the printing plate. Since bending the printing plate increases the likelihood of plate cracking, the elimination of bends in the plate is advantageous. The bonding plate 80 is preferably made of the same material as the printing plate 30. The lead and tail ends of the printing plate can be bonded to the bonding plate with an adhesive or by welding. Examples of suitable welding techniques include TIG, Resistance Seam, and Electron Beam welding. Preferably, the lead end 40 abuts the tail end 47 as shown in FIG. 5 in order to minimize the gap in the surface of the printing plate 30. The printing plate is mounted axially over the plate cylinder with pressurized fluid in the manner described above with regard to FIGS. 1 through 4. The bonding plate 80 rests within the axial recess 11' and slot 20' of the plate cylinder 1'. As a result, the printing plate 30 will not slip relative to the plate cylinder during printing. Alternatively, a rectangular shaped bonding plate could be employed in combination with a plate cylinder with a deeper recess, with the recess impeding slippage of the printing plate.

Figure 6A:
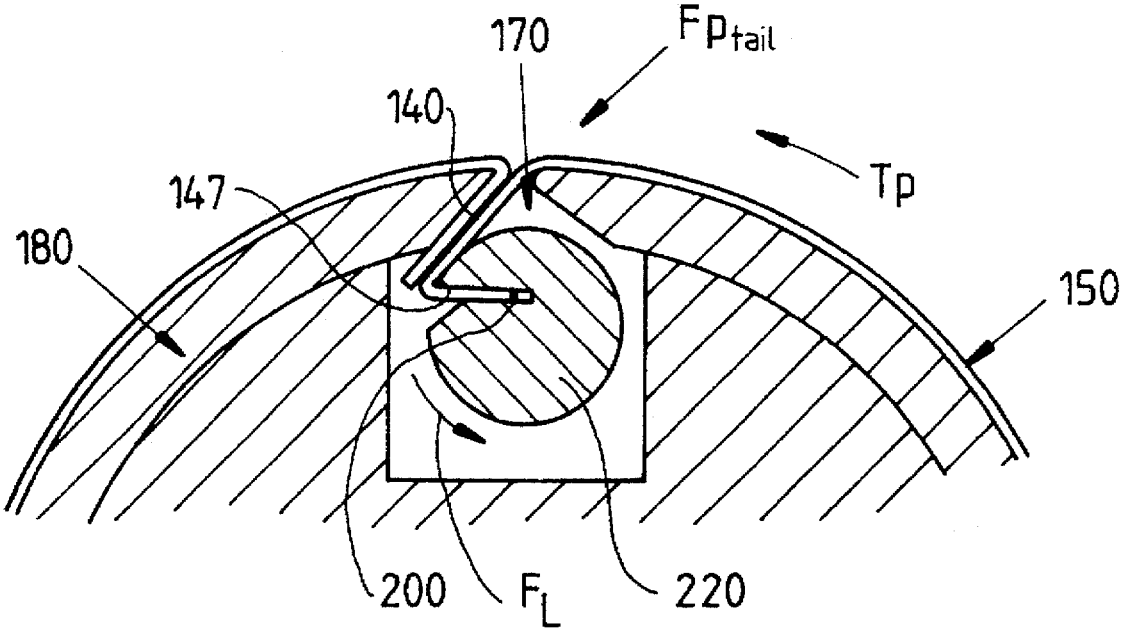
Fig.6a Prior Art
FIGS. 6(*c,d*) illustrate the forces resulting from mounting a printing plate onto a plate cylinder in accordance with the present invention.
Figure 6B:
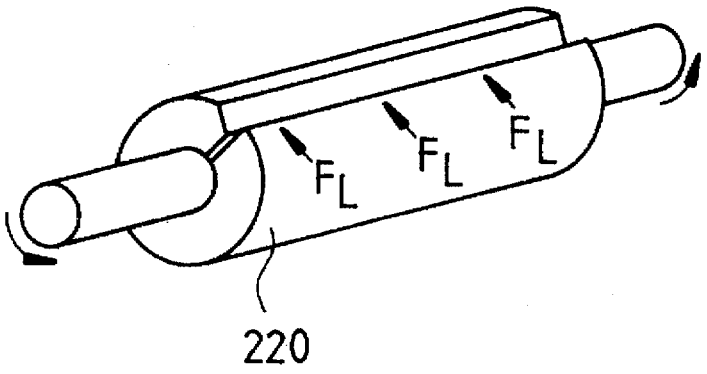
Fig.6b Prior Art
Figure 6C:
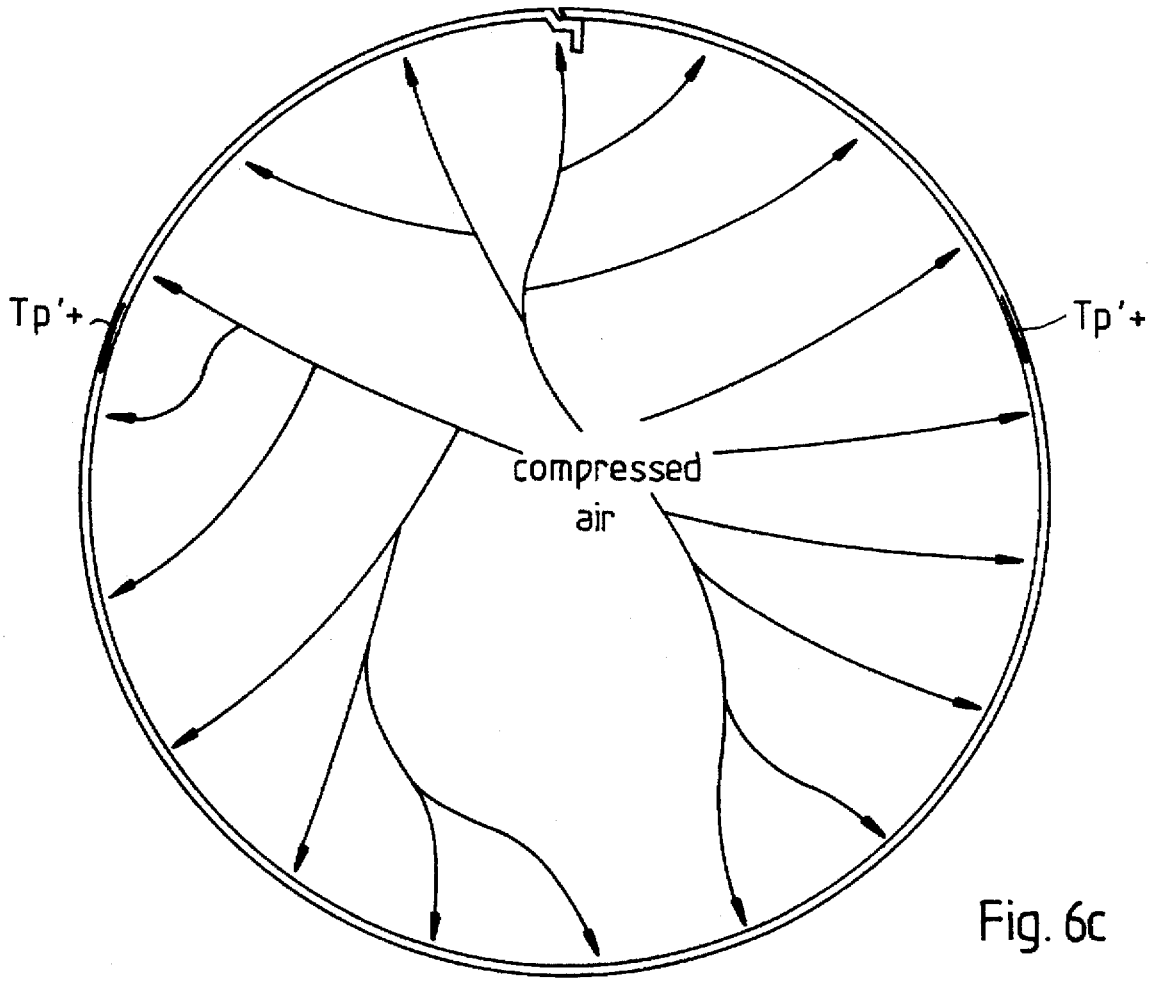
Figure 6D:
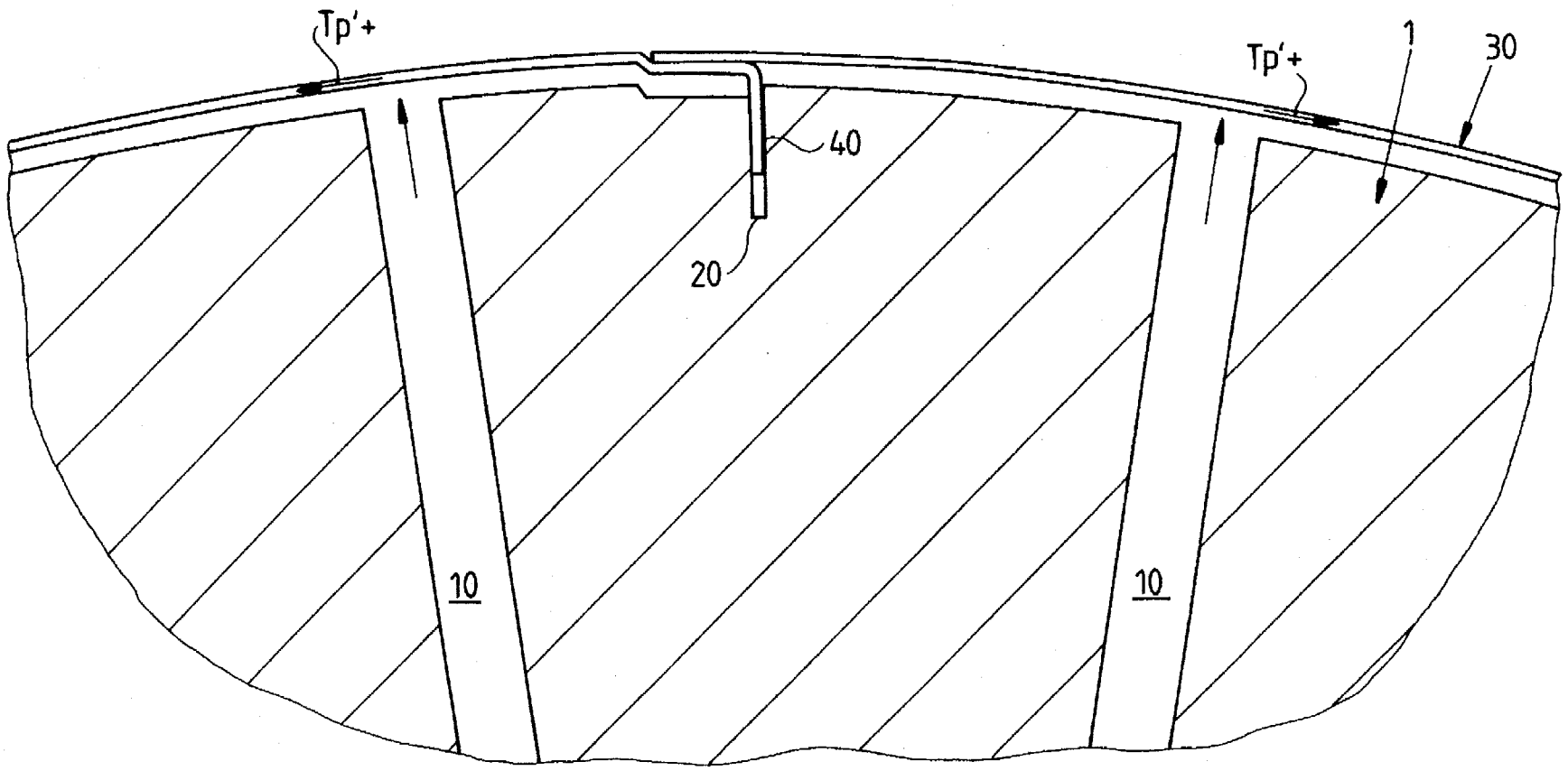
Figure 7A:
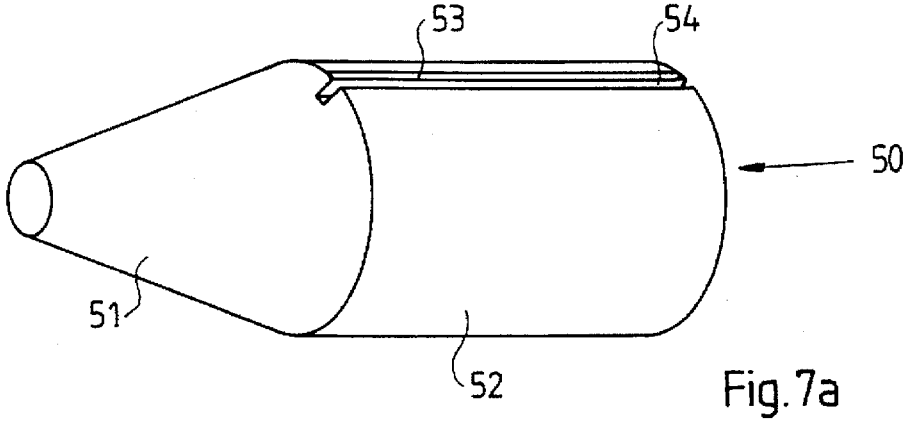
FIG. 7(*a*) shows a mounting mandrel in accordance with the present invention.
Figure 7B:
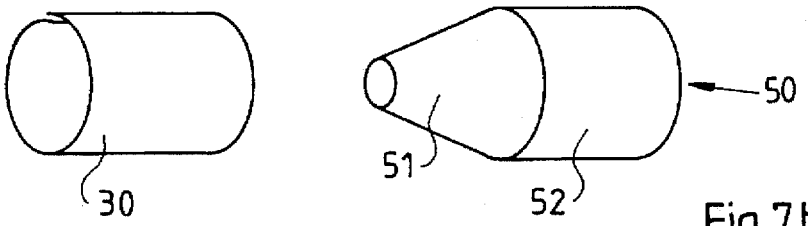
Figure 7D:
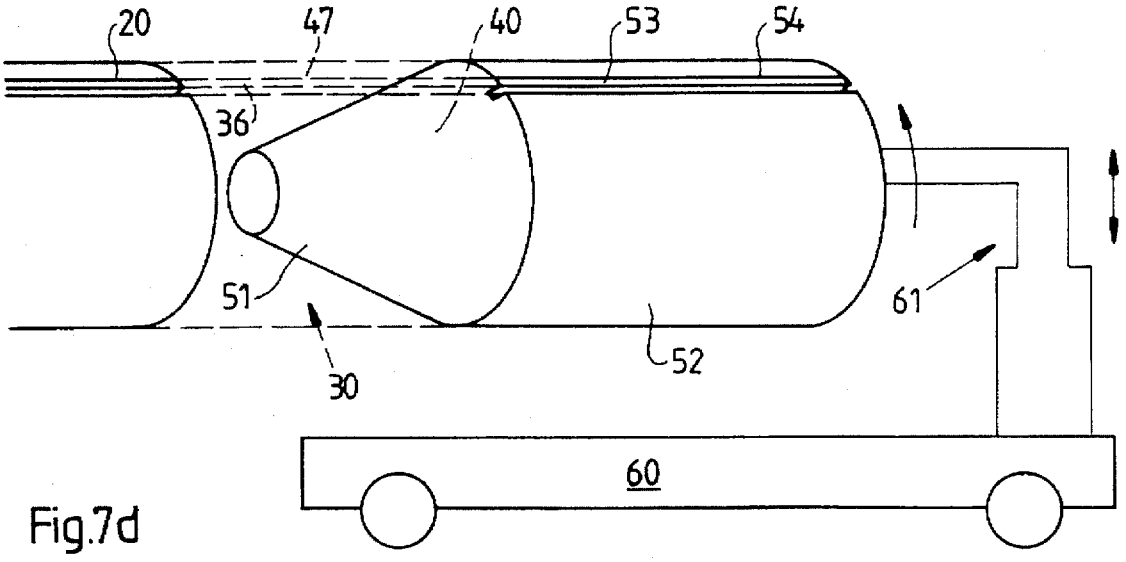
Figure 7C:
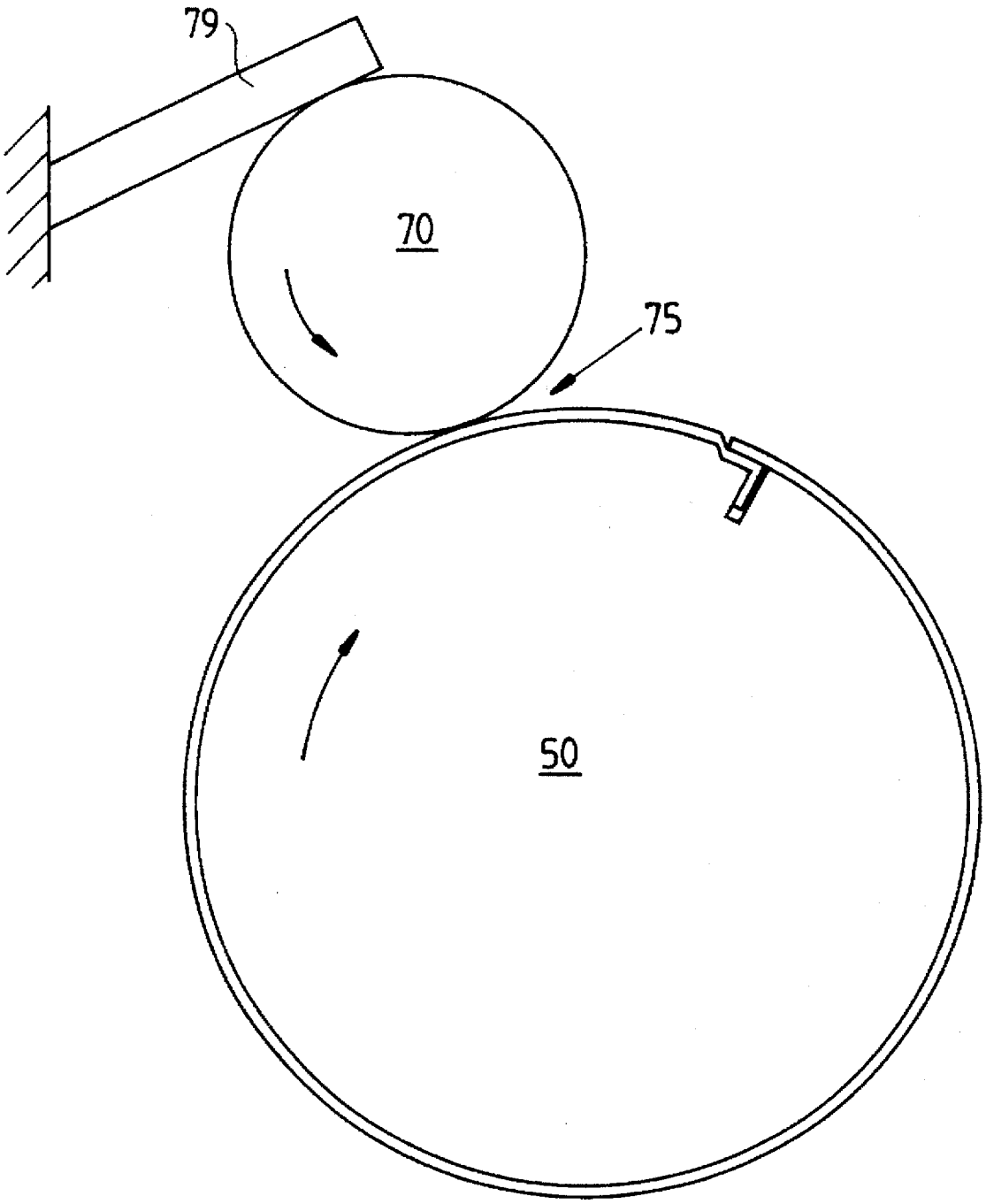

FIGS. 6*a,b* show a prior an reel-rod lock-up arrangement for a plate cylinder 180. In this system, a bend is made in the lead end 140 and in the tail end 147 of the printing plate 150. The lead end 140 is hooked onto a first side of a plate cylinder gap 170, and the printing plate 30 is wrapped circumferentially around the plate cylinder by a clockwise rotation of the plate cylinder 180. The tail end 147 of the printing plate is then inserted through the plate cylinder gap 170 and into an axial gap 200 in a reel-rod 220. The reel-rod 220 rotates counter-clockwise as shown, thereby securing the printing plate 30 to the plate cylinder. As discussed above, a disadvantage of reel-rod lock-ups is that they result in non-uniform forces being applied to the printing plate. These non-uniform forces, in turn, increase the likelihood of plate cracking, and may cause the plate to slip out of the end portions of the reel-rod 220.

As the reel-rod 220 is rotated, it applies a force $F_L$ to the tail end of the printing plate. However, since the reel-rod 220 can only be twisted at each end, the force applied at the center of the reel-rod 220 is less than the force applied at the ends due to the torsional deflection of the reel-rod 220. In addition, the direction of the resultant force applied at the tail end of the printing plate ($Fp_{tail}$) is different than the direction of the force Tp which is needed to hold the printing plate 150 onto the plate cylinder 180. Only a portion of the available force at the reel-rod ($F_L$) is applied as the force $Fp_{tail}$ due to frictional losses. Similarly, due to frictional losses, only a portion of the available force $Fp_{tail}$ is applied as the force Tp. Therefore $Tp < Fp_{tail} < F_L$. As a result, the tension in the plate Tp, which is required to hold the plate to the cylinder, ends up being quite small in comparison to $F_L$. Due to large frictional losses, or to the ends of the plate slipping out of the reel-rod, it is often difficult to obtain a sufficient tension Tp to hold the entire plate 30 in surface contact with the plate cylinder 180. In addition, since the force $F_L$ is non-uniform across the length of the reel-rod 220, the force $Fp_{tail}$ applied to the printing plate will also be non-uniform. Thus, Tp will also be non-uniform. As discussed above, these non-uniform forces increase the likelihood of plate cracking, and may cause the plate to slip out of the end portions of the reel-rod 220.

In contrast, as shown in FIGS. 6(*c, d*), in accordance with the present invention, the printing plate is mounted axially over the plate cylinder while in a radially expanded state. The radial pressure of the compressed air creates a uniform reactionary force Tp'+, which is slightly greater than Tp', throughout the plate in the circumferential direction during installation. Once installation is complete, and the air pressure is removed, a uniform force Tp' remains in the circumferential direction. Moreover, since the force Tp' results from the interference fit between the printing plate and plate cylinder, the force Tp' is uniform across the width and circumference of the plate. Therefore, this construction applies less force at the tail ends of the plate than the force $Fp_{tail}$ of prior art reel-rod arrangements, but is capable of applying a force Tp' which is greater than the force Tp of prior art reel-rod arrangements. Moreover, the force Tp' is applied in a uniform manner across the entire plate. As a result, this construction reduces the likelihood of plate cracking.

In accordance with a further embodiment of the present invention, each blanket cylinder 2 includes a plurality of apertures 10 along the outer surface of the blanket cylinder 2 as shown in FIG. 1. The apertures 10 are coupled to the source of compressed fluid 49. A tubular printing blanket 70 is mounted axially over the blanket cylinder. Examples of suitable tubular printing blankets are described in U.S. Pat. Nos. 5,304,267, 5,323,702, and 5,429,048, the specifications of which are hereby incorporated by reference. While only a single side frame 3 is shown supporting one end of the cylinders 1, 2 in FIG. 1, it should be understood that a second side frame (not shown) may be provided to support the other end of the cylinders 1,2. In such a configuration, openings are provided in the second side-frame to allow installation and removal of the plates 30 and blankets 70.

FIGS. 7(*a–d*) show a mounting mandrel 50 in accordance with a further embodiment of the present invention. The mounting mandrel 50 has a conical section 51 and a cylindrical section 52. A mandrel slot 53 is disposed axially across the cylindrical section 52. Preferably, a mandrel recess 54 is disposed adjacent to the mandrel slot 53. A conventional three roll sheet bender is used to prebend the printing plate 30 into a cylindrical shape. Then, an operator grasps the lead end 40 and the tail end 47 of the printing plate 30 and slides the printing plate axially over the conical section 51 of the as shown in FIG. 7*b*.

If the printing plate is formed in accordance with the embodiments of FIGS. 3 and 4, the following procedure may be followed. First, the bends 31, 32, 33 in the plate 30 may be formed using a stamping process. Then, the plate 30 is fed through a three roll sheet bender to form the plate 30 into a cylindrical shape. The printing plate 30 is then slid axially over the mounting mandrel, and the angular end portion 36 of the plate is slid into the mandrel slot 53. Referring to FIG. 7(*c*), a rubber covered top pressure roller 70 is then lowered into contact with the plate 30 on the mounting mandrel 50 so that the pressure roller 70 and the mounting mandrel 50 are in rolling engagement at a nip 75. Tension between the pressure roller 70 and mounting mandrel 50 is maintained by a tensioning device 79. The tensioning device 79 can be of any known construction. For example, the tensioning device 79 could be a block of wood which rests on top of the pressure roller 70.

As the mounting mandrel 50 rotates clockwise, it drives the pressure roller 70 rotates counter-clockwise through friction. The tensioning device 79 resists this movement, causing the pressure roller 70 to apply tension to the plate 30, tightly wrapping the plate 30 around the mounting mandrel 50. Then, an adhesive is applied to the recessed portion 35 just before the recessed portion 35 enters the nip 75 between the mounting mandrel 50 and pressure roller 70. As the mounting mandrel 50 and pressure roller 70 continue to rotate, the tail end 47 of the printing plate is bonded to the recessed portion 35. Once the tail end 47 is bonded to the recessed portion 35, the printing plate can be removed from the mounting mandrel and mounted onto the plate cylinder 1. Since the diameter of the mounting mandrel is slightly smaller than the diameter of the plate cylinder, an interference fit will be created when the plate is mounted on the plate cylinder.

If the printing plate is formed in accordance with the embodiment of FIG. 5, then the following procedure may be followed. First, the bonding plate 80 is bonded to a fast end of the printing plate. Then, the plate 30 is fed through the three roll sheet bender to form the plate into a cylindrical shape. The printing plate is then slid axially over the mounting mandrel, and the bonding plate 80 is slid into the mandrel recess 54. The rubber covered top pressure roller is then lowered into contact with the plate on the mounting mandrel so that the pressure roller and the mounting mandrel are in rolling engagement. As the mounting mandrel rotates clockwise, and the pressure roller rotates counter-clockwise, the plate is tightly wrapped around the mounting mandrel. Then, an adhesive is applied to the exposed half of the bonding plate 80 just before the bonding plate 80 enters the nip between the mounting mandrel and pressure roller. As the mounting mandrel and pressure roller continue to rotate, the second end of the printing plate is bonded to the bonding plate 80. Once the second is bonded to the bonding plate 80, the printing plate can be removed from the mounting mandrel and mounted onto the plate cylinder 1.

In accordance with the above embodiment, the conical section 51 serves to gradually shape the printing plate to the diameter of the cylindrical section 52 of the mounting mandrel as the plate is slid axially over the conical section 51 and cylindrical section 52 as shown in FIG. 7(*b*). However, it is also possible to eliminate the conical section 51 and the shape the printing plate to the proper diameter by hand.

In accordance with a further embodiment of the present invention, the mounting mandrel 50 may be used to position the plate 30 relative to the plate cylinder 1 in order to facilitate installation of the plate 30 onto the plate cylinder 1. For example, as shown in FIG. 7(*d*), the mandrel 50 may be mounted on a positioning platform 60. The positioning platform 60 may further include a positioning arm 61 for aligning the mandrel 50 with the plate cylinder 1. The positioning arm 61 may be configured to allow the vertical and circumferential position of the mandrel 50 to be set. Once the height of the mandrel 50 has been set to correspond to the height of the plate cylinder 1, and the slot 53 and/or recess 54 has been aligned with the slot 20, the plate 30 can be slid off of the mandrel 50 and onto the plate cylinder 1 as illustrated by the dashed lines in FIG. 7(*d*). The circumferential and vertical position of the mandrel 50 could be adjusted manually, for example, with clamps 80. Alternatively, it could be controlled with hydraulic or pneumatic pistons, or in any other known manner.

It should be understood that the mounting mandrel 50 need not be used in combination with the fixed tensioning printing plate 30, but could also be used with other plate mounting systems. Similarly, the fixed tensioning printing plate 30 need not be used in conjunction with the mounting mandrel 50.

What is claimed is:

1. A printing plate having a lead end and a tail end, a first bend and a second bend disposed at a first distance from the lead end, the first and second bends forming opposing angles on the printing plate, a third bend disposed at a second distance from the lead end, the third bend forming an opposing angle relative to the second bend, an angular end portion being formed between the third bend and the lead end, a recessed portion being formed between the second bend and the third bend, the tail end being bonded to the recessed portion.

2. The printing plate of claim 1, wherein the angular end portion is perpendicular to the recessed portion.

3. The printing plate of claim 1, wherein the angular end portion forms an acute angle with the recessed portion.

4. A fixed tensioning plate mounting system for a printing press, comprising:

a plate cylinder having a axial slot disposed therein, a plurality of apertures being disposed on an outer surface of the plate cylinder, a source of pressurized fluid coupled to the apertures;

a printing plate having a lead end and a tail end, a first bend and a second bend disposed at a first distance from the lead end, the rest and second bends forming opposing angles on the printing plate, a third bend disposed at a second distance from the lead end, the third bend forming an opposing angle relative to the second bend, an angular end portion being formed between the third bend and the lead end, a recessed portion being formed between the second bend and the third bend, the tail end being bonded to the angular end portion, the printing plate being axially mounted on the plate cylinder.

5. The fixed tensioning plate mounting system according to claim 4, further comprising an axially extending recess disposed adjacent to the axial slot.

6. The fixed tensioning plate mounting system of claim 5, wherein the angular end portion is perpendicular to the recessed portion.

7. The fixed tensioning plate mounting system of claim 5, wherein the angular end portion forms an acute angle with the recessed portion.

8. The fixed tensioning plate mounting system according to claim 5, wherein a width of the angular end portion is approximately equal to a width of the axially extending recess.

9. The fixed tensioning plate mounting system according to claim 4, wherein the second distance is less than or equal to a depth of the axially extending slot.

10. A method for axially mounting a flat printing plate over a plate cylinder, comprising the steps of:

forming opposing first and second bends at a first distance from a lead end of a printing plate;

forming a third bend at a second distance from the lead end, an angular end portion thereby formed between the third bend and the lead end, a recessed portion thereby formed between the second bend and third bend;

bonding a tail end of the printing plate to the recessed portion;

aligning the angular end portion of the printing plate with an axial slot in a plate cylinder;

mounting the printing plate axially over the plate cylinder.

11. The method according to claim 10, further comprising the step of radially expanding the printing plate as it is axially mounted over the plate cylinder.

12. The method according to claim 11, wherein the step of radially expanding further comprises the steps of applying pressurized fluid through a plurality of apertures on an outer surface of the plate cylinder to radially expand the printing plate as it is slid axially over the plate cylinder.

13. The method according to claim 10 further comprising the step of sliding the printing plate axially over a cortically shaped mounting mandrel prior to the bonding step.

14. A mounting mandrel, comprising a cylindrically shaped first portion having an outer surface, a first end and a second end, an axial slot disposed along the outer surface for receiving an end of a printing plate;

a conically shaped second portion connected to the first end of the cylindrically shaped first portion, the conically shaped second portion for axially receiving the printing plate and reshaping the printing plate prior to being slid over the cylindrically shaped first portion.

15. The mounting mandrel according to claim 14, further comprising an axial recess disposed adjacent to the axial slot along the outer surface of the plate cylinder.

16. The mounting mandrel according to claim 14, further comprising a positioning are connected to the second end of the cylindrically shaped first portion, the positioning arm controlling the height and circumferential position of the cylindrically shaped first portion.

17. The mounting mandrel according to claim 16, further comprising a movable base portion connected to the positioning are, the movable base portion and positioning are supporting the cylindrically shaped first portion and the conically shaped second portion, the movable base portion controlling the lateral position of the mounting mandrel.

18. A method for axially mounting a flat printing plate over a plate cylinder, comprising the steps of:

forming opposing first and second bends at a first distance from a lead end of a printing plate;

forming a third bend at a second distance from the lead end, an angular end portion thereby formed between the third bend and the lead end, a recessed portion thereby formed between the second bend and third bend;

sliding the printing plate axially over a conical end portion of a mounting mandrel to reshape the printing plate;

inserting the angular end portion within a first axial slot in a cylindrical first portion of the mounting mandrel;

bonding a tail end of the printing plate to the recessed portion;

aligning the first axial slot of the mounting mandrel with a second axial slot in a plate cylinder;

mounting the printing plate axially over the plate cylinder.

19. The method according to claim 18, further comprising the step of radially expanding the printing plate as it is axially mounted over the plate cylinder.

20. An offset lithographic printing press, comprising:

a frame;

a plate cylinder mounted on the frame, the plate cylinder having a axial slot disposed therein, a plurality of first apertures being disposed on an outer surface of the plate cylinder, a source of pressurized fluid coupled to the first apertures;

a blanket cylinder mounted on the frame, a plurality of second apertures being disposed on an outer surface of the blanket cylinder, the source of pressurized fluid coupled to the second apertures;

a printing plate having a lead end and a tail end, a first bend and a second bend disposed at a first distance from the lead end, the first and second bends forming opposing angles on the printing plate, a third bend disposed at a second distance from the lead end, the third bend forming an opposing angle relative to the second bend, an angular end portion being formed between the third bend and the lead end, a recessed portion being formed between the second bend and the third bend, the tail end being bonded to the recessed portion, the printing plate being axially mounted on the plate cylinder; and a gapless tubular printing blanket being axially mounted on the blanket cylinder.

21. A printing plate having a lead end and a tail end, a first bend and a second bend disposed at a first distance from the lead end, a third bend disposed at a second distance from the lead end to define a recessed portion between the second bend and the third bend and an angular end portion between the third bend and the lead end, the tail end being bonded to the recessed portion.

22. A fixed tensioning plate mounting system for a printing press, comprising:

a plate cylinder having a axial slot disposed therein, a plurality of apertures being disposed on an outer surface of the plate cylinder, a source of pressurized fluid coupled to the apertures;

a printing plate having a lead end and a tail end, a first bend and a second bend disposed at a first distance from the lead end, a third bend disposed at a second distance from the lead end to define a recessed portion between the second bend and the third bend and an angular end portion between the third bend and the lead end, the tail end being bonded to the recessed portion, the printing plate being axially mounted on the plate cylinder.

23. A printing plate having an inner surface and an outer surface, and having a lead end and a tail end, the tail end and the lead end being bonded to a T-shaped bonding plate.

24. A fixed tensioning plate mounting system for a printing press, comprising:

a plate cylinder having an axial recess and axial slot disposed therein, a plurality of apertures being disposed on an outer surface of the plate cylinder, a source of pressurized fluid coupled to the apertures;

a printing plate having a lead end and a tail end, the lead end and the tail end being bonded to a T-shaped bonding plate, the printing plate being axially mounted on the plate cylinder through expansion by the pressurized fluid, the bonding plate being received in the axial recess and axial slot.

* * * * *